US009993911B1

(12) United States Patent
Santangelo

(10) Patent No.: US 9,993,911 B1
(45) Date of Patent: Jun. 12, 2018

(54) WRENCH SYSTEM; SIDE LOADING, INSERT USING, RATCHETING, OPEN END, PASS THROUGH, SOCKET, QUICK CHANGING, FASTENER RETAINING, REVERSIBLE, MANUAL OR POWERED, VARIABLE HIGH SPEED, TORQUE SENSING, FLARE NUT

(71) Applicant: Anthony Santangelo, Cherry Hill, NJ (US)

(72) Inventor: Anthony Santangelo, Cherry Hill, NJ (US)

( * ) Notice: Subject to any disclaimer, the term of this patent is extended or adjusted under 35 U.S.C. 154(b) by 197 days.

(21) Appl. No.: 14/592,636

(22) Filed: Jan. 8, 2015

Related U.S. Application Data

(60) Provisional application No. 61/926,465, filed on Jan. 13, 2014.

(51) Int. Cl.

| | |
|---|---|
| ***B25B 13/46*** | (2006.01) |
| ***B25B 13/08*** | (2006.01) |
| ***B25B 21/00*** | (2006.01) |
| ***B25B 23/12*** | (2006.01) |

(52) U.S. Cl.
CPC ..... *B25B 13/46* (2013.01); *B25B 13/08* (2013.01); *B25B 21/004* (2013.01); *B25B 23/12* (2013.01)

(58) Field of Classification Search
CPC ..... B25B 13/46; B25B 13/08; B25B 13/48; B25B 13/58; B25B 21/002; B25B 21/004
See application file for complete search history.

(56) References Cited

U.S. PATENT DOCUMENTS

| | | | | | |
|---|---|---|---|---|---|
| 2,550,010 | A | * | 4/1951 | Kavalar | B25B 13/46 192/45.018 |
| 2,636,411 | A | * | 4/1953 | Wood | B25B 13/08 81/58.2 |
| 2,810,313 | A | * | 10/1957 | Hermanson | B25B 13/46 81/176.3 |
| 2,896,488 | A | * | 7/1959 | Ahana | B25B 13/46 81/183 |
| 3,097,551 | A | * | 7/1963 | Schmitt | B25B 21/002 81/470 |
| 3,477,318 | A | * | 11/1969 | Batten | B25B 17/00 81/57 |
| 3,604,106 | A | * | 9/1971 | Borries | B25B 13/02 29/434 |
| 5,107,729 | A | * | 4/1992 | Makhlouf | B23D 21/04 81/57.14 |
| 5,392,671 | A | * | 2/1995 | Hazzard | B25B 13/481 81/57.13 |
| 5,522,285 | A | * | 6/1996 | Wilson, Jr. | B25B 13/48 81/57.14 |

(Continued)

*Primary Examiner* — David B Thomas
(74) *Attorney, Agent, or Firm* — Anthony Santangelo, Esq.

(57) ABSTRACT

The jaw easily allows an insert to be installed or removed. Roughly circular, an insert will be held captive by the pins or semi-circles in the jaw engaging with a groove in the inserts circumference. This will allow the insert to rotate even with a part of its circle not engaged. This will allow an insert to be open ended. This open ended feature will allow this tool to rotate a fastener like a nut even if the end of the threaded portion, perhaps a bolt, cannot be accessed. Once installed the insert will be able to be turned in a circular motion with heavy torque by either manual or powered means.

17 Claims, 4 Drawing Sheets

(56) References Cited

U.S. PATENT DOCUMENTS

| | | | | |
|---|---|---|---|---|
| 9,381,625 | B2 * | 7/2016 | Chen | B25B 21/004 81/57.13 |
| 9,393,676 | B2 * | 7/2016 | Weber | B25B 13/463 81/58.2 |
| 2003/0080703 | A1 * | 5/2003 | Elliott | B25B 21/002 318/432 |
| 2006/0288822 | A1 * | 12/2006 | Langas | B25B 13/04 81/59.1 |
| 2008/0289456 | A1 * | 11/2008 | Jensen | B25B 13/08 81/124.2 |
| 2012/0103142 | A1 * | 5/2012 | Sroka | B25B 13/48 81/57.11 |
| 2013/0025416 | A1 * | 1/2013 | Dedrickson | B25B 21/004 81/57.11 |
| 2015/0273667 | A1 * | 10/2015 | Hielscher | B25B 13/08 81/57.22 |
| 2016/0031067 | A1 * | 2/2016 | Batt | B25B 13/08 81/57.29 |
| 2016/0235200 | A1 * | 8/2016 | De Bruin | A47B 91/02 248/188.4 |

* cited by examiner

WRENCH SYSTEM; SIDE LOADING, INSERT USING, RATCHETING, OPEN END, PASS THROUGH, SOCKET, QUICK CHANGING, FASTENER RETAINING, REVERSIBLE, MANUAL OR POWERED, VARIABLE HIGH SPEED, TORQUE SENSING, FLARE NUT

CROSS-REFERENCE TO RELATED APPLICATIONS

This Non-Provisional Application claims the filing date of the Provisional application No. 61/926,465 filed Jan. 13, 2014 by this applicant.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Field of the Invention

This invention is in the field of hand held tools, ratcheting tools, open end tools, tools and wrenches manual, electric, battery, hydraulic, air or otherwise powered.

Description of the Related Art

Primitive open end ratcheting tools of various types have been seen in the prior art. The prior art consists of poorly designed tools which have not the functionality described to enable them to do the actions they claim. These earlier tools do not demonstrate that any reduction to practice was achieved.

BRIEF SUMMARY OF THE INVENTION

This invention is a ratcheting, open ended wrench that allows the user to tighten or loosen fasteners like an open end wrench but with a manual or powered handle. Fasteners on threaded parts too long to use a socket wrench or fasteners that attach piping or tubing are likely uses. Additional uses include long fasteners where the end of the fastener cannot be accessed to bring a closed headed tool over it such as a socket or box wrench. This tool system comprises a new type of handle and rotating insert and adapters to use standard sockets and extensions of all types. Sockets, extensions, swivel joints and all types of socket tool accessories currently existing can be modified to be used in this proprietary handle system

DETAILED DESCRIPTION OF THE SEVERAL VIEWS OF THE DRAWING

The drawings illustrate the handle with jaw, the rotating insert and the insert retaining detail of this invention as well as a rotating insert as a socket and a rotating insert as an adapter.

Figure 1:
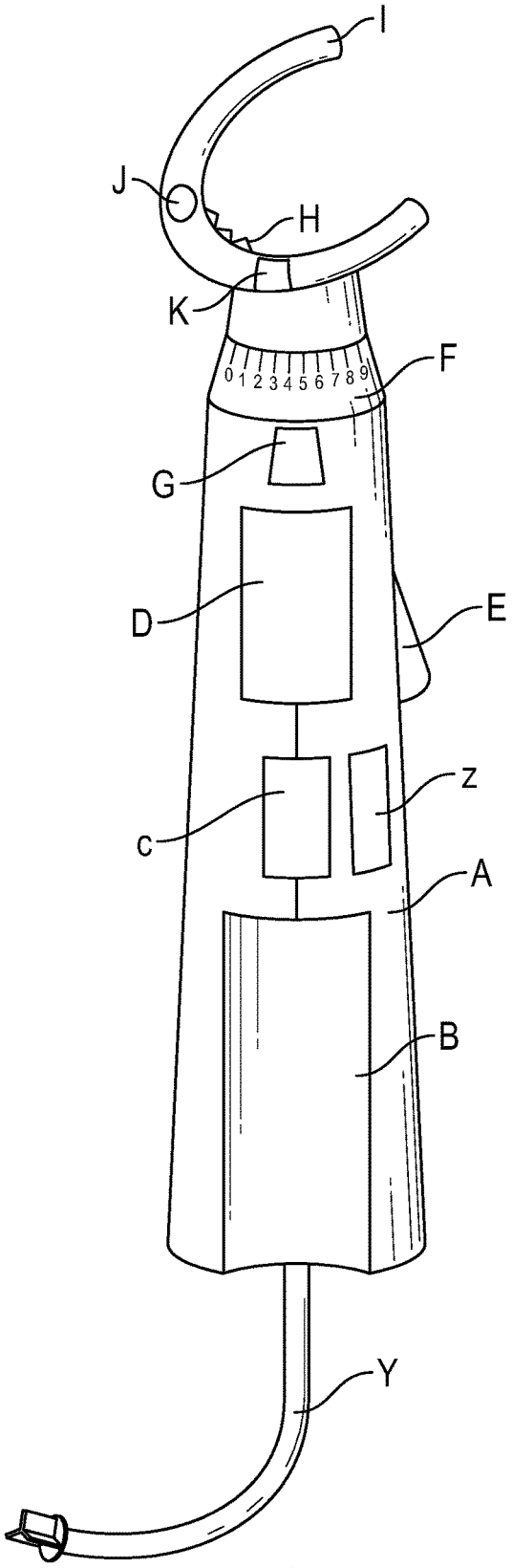
FIG. 1 is a schematic illustration, in plan view of a preferred embodiment of the invention.

FIG. 1 demonstrates the overall view of a best mode of the total access wrench.

Label A indicates the handle of the tool that can be in any configuration suitable for use as a manual or power tool held with the hands.

Label B describes a section of the handle that would be used to contain a battery, reservoir or other power source or component for the tool if powered.

Label C indicates a switch, valve or connection between a power source and another portion of the instrument.

Label D indicates a motor or motivating unit of some sort that may be powered by batteries, pneumatics or hydraulics.

Label E indicates a switch whose function will be to rotate the insert to its proper index location, and set the tool to forward neutral reverse and variable speed in either direction.

Label F indicates a dial or some other control used to increase or decrease the torque of the tightening of the device.

Label G indicates the mechanism that will actually turn the rotating insert in the jaw. This might be a worm and gear device or a pawl that pushes or pulls the rotating insert in the jaw or any other mechanism known to PHOSITA.

Label H indicates a pawl or other device in the jaw that will engage the rotating insert and turn it.

Label I indicates the jaw of the device which will be shaped in such a way to capture and contain a circular replaceable disc and also to be at the angle most appropriate for working with various fasteners. This jaw may have a slot to further retain the rotating insert M.

Label J indicates a button or other device which when activated will cause the locking mechanism of the jaw to be unlocked so that the circular inserts can be inserted or released.

Label K indicates a sensor or other device that will allow the insert to rotate and find the position where the open end of the insert is in the optimal position.

Label Y shows a power cable if A/C powered or a hose if pneumatically or hydraulically powered.

Label Z depicts any other needed circuitry or controls which may consist of a TCO, or potentiometer for torque sensing or any other needed mechanism. Insert M is inserted into jaw I to use the tool.

Figure 2:
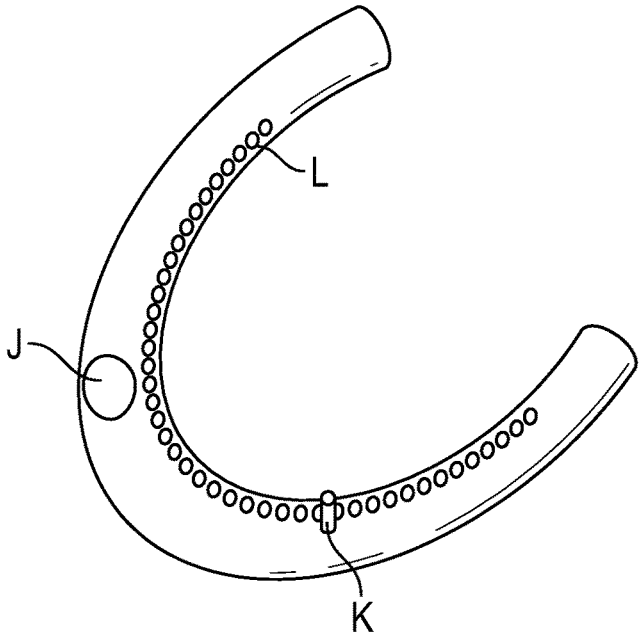
FIG. 2 is a schematic drawing, in plan view of the jaw (I) of the invention.

FIG. 2 further demonstrates the detail of jaw I. This figure shows the position of J, the depressing button. K, the sensor and item L that is a series of pins, lands semicircular shapes or any other type of capturing device that will reside in wells in the jaw and be forced to the center by springs constituting a locking mechanism. This will allow the insert to be captured and to rotate and yet allow a firm torque to be applied to a fastener.

Figure 3:
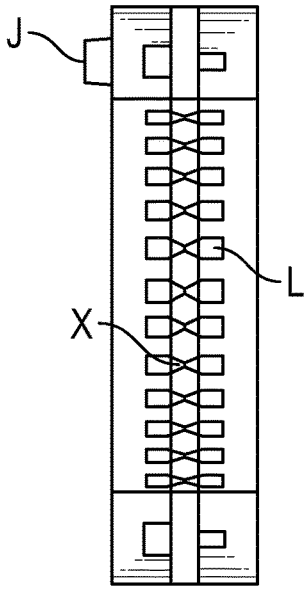
FIG. 3 is a schematic drawing, in side plan view into the jaw of the invention.

FIG. 3 demonstrates the row of pins or other locking devices in Jaw I. The locking pins or other device labeled L will open when button J is depressed to allow a rotating insert to be captured and to rotate in a circular fashion. This is the locking mechanism of this invention. Jaw I may be slotted to further contain the insert; slot depicted by label X.

Figure 4:
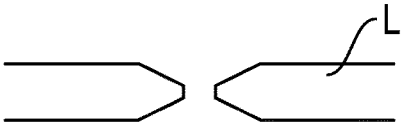
FIG. 4 is a schematic drawing showing the detail of the capturing pins (L) in the jaw (I).

FIG. 4 demonstrates the fine detail of capturing pins L. These pins or other device may be chamfered in the middle which would allow the disk to be pressed in more easily and locked, perhaps without depressing button J or by lightly pressing J.

Figure 5:
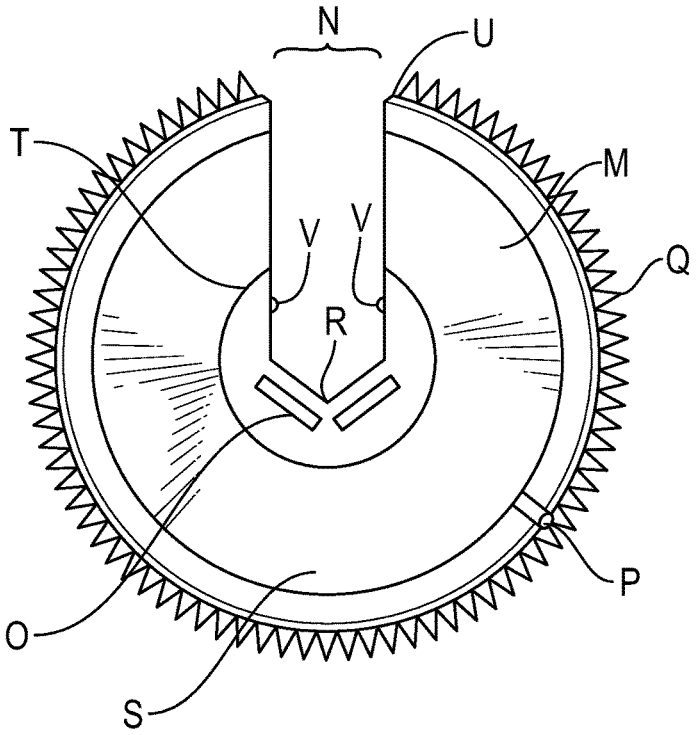
FIG. 5 is a schematic drawing of the top of the rotating insert (M), in plan view.

FIG. 5 depicts a top view of a rotating insert. This insert is generally circular with teeth around its outer edge labeled Q to engage a pawl or worm gear and a groove labeled S which can be placed anywhere on the surface but which will be best placed around the circumference near the edge. Label P shows a device incorporated in the insert that will allow it to be rotated to an optimum angle. This device may be a magnet or a bump in the circle to activate sensor k or any other type of device as known to Phosita.

Label M depicts the main body of the insert. Label T depicts the area of the insert that will be swelled in thickness to appropriately capture and turn the fastener whose size this insert is. T will be the appropriate thickness for use as an open end wrench for the tightening of a fastener anywhere along slot N.

Label O depicts a magnet that will help to capture fasteners and keep them centered in the middle of the insert while turning. A method of holding a fastener in the center of the insert while rotating is desired.

Label Q depicts the teeth around the edge of the rotating insert that will be used to engage with the operation of the handle. These may be of several angles depending on whether operation is by a pawl of some type a worm screw or otherwise.

Label R depicts the center of the insert that will be sized to turn appropriate fasteners. For example if a half inch hexagonal nut is being turned, R will be slightly more than one half-inch and accommodate a hexagonal fastener.

Label N depicts a slot in this rotating insert. This slot will have characteristics suitable for acting as an open end type wrench and as a slot to which a fastener will be centered in the area R. This slot may have a slight chamfer U where it is opened slightly to allow it to easily slide over a fastener with the same approximate width. Also this Slot may have a mechanism V in which it will allow a fastener to be more physically captured by the rotating insert. This may consist of a very slight protuberance in the casting to create an interference fit or small nylon or rubber knobs or any other known configuration that will hold the fastener in the center R.

Figure 6:
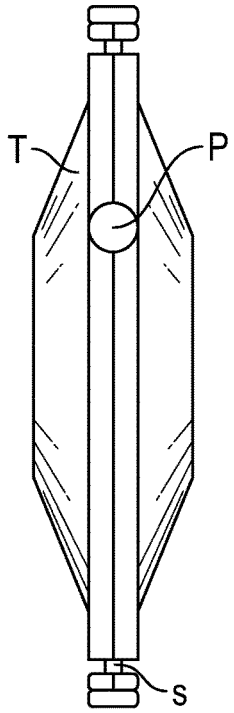
FIG. 6 is a schematic drawing, in plan view of the side of the rotating insert (M).

FIG. 6 shows a side view of the rotating insert. This shows how P will be placed around the edge of the insert or any other suitable spot. This shows how T, the swelling in the insert will hold a fastener and it depicts Slot S. which will be a slot on either one or both sides of the insert.

Figure 7:
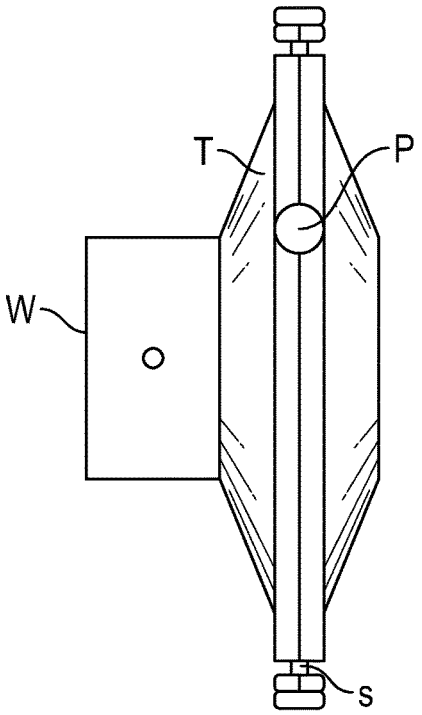
FIG. 7 is a schematic drawing, in plan view of the side of a rotating insert embodiment used to drive standard socket tools.

FIG. 7 shows a rotating insert which is configured to work with standard socket tools. Square protuberance W will be sized to fit standard sockets and their accessories. These are typically ¼, ⅜, ½, ¾, 1 inch etc. square drives with sprung detents to capture and hold the attachments.

Figure 8:
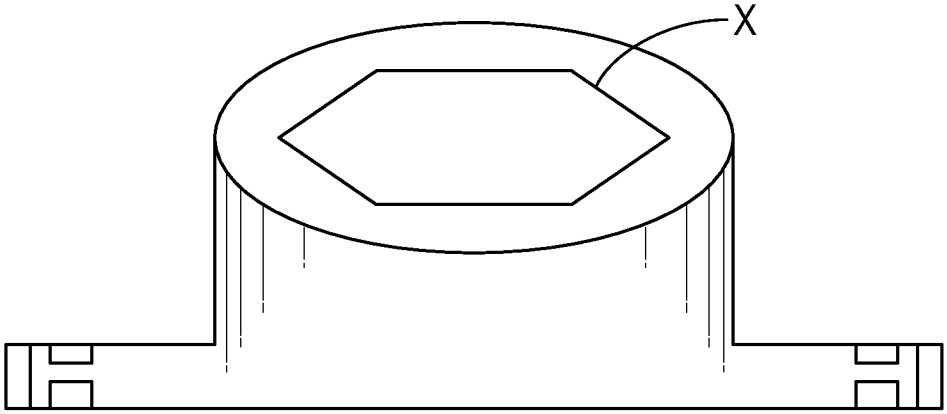
FIG. 8 is an isometric drawing of a rotating insert with a socket sized for standard fasteners.

FIG. 8 depicts a socket that could be used in the total access handle. This socket would be sized for standard fasteners and the open dimension is depicted by label X that could be of any configuration square, hexagonal or otherwise.

Figure 9:
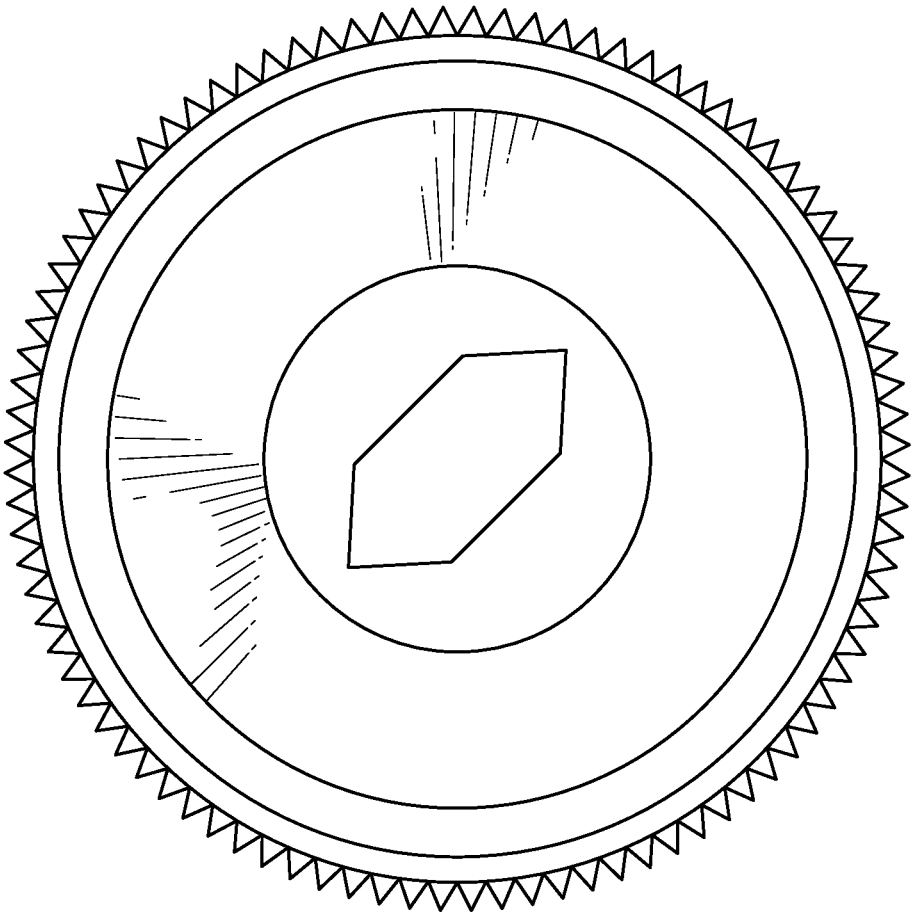
FIG. 9 is a schematic drawing, in plan view of the top of the rotating insert with a socket sized for standard fasteners.

FIG. 9 depicts a top view of this insert that is shown shaped to turn standard hexagonal fasteners like a standard socket of the same size. Any type of standard socket set accessory can be made to work in the total access system in this manner.

DETAILED DESCRIPTION OF THE INVENTION

This invention is a new type of ratcheting, open ended wrench that allows the user to tighten or loosen fasteners like an open end wrench but with a manual or powered handle. This tool has pass through functionality so it will work with any length fastener. Fasteners on threaded parts too long to use a socket wrench like threaded rod couplings or fasteners that attach piping or tubing are likely uses. This tool system comprises a new type of handle, rotating inserts, sockets, extensions, swivel joints and all types of socket tool accessories currently invented modified to be used in this proprietary handle system and adapters to use standard sockets and extensions of all types.

The handle can be manual, motor driven or otherwise. If it contains a motor it can be powered by any source such as battery, air, hydraulic or household current. The handle will contain the components required to function in the particular type that it is and comply with all countries safety regulations. A battery powered tool will contain a battery perhaps removable and rechargeable and all other required components for control and safety of a battery powered tool. A handle for alternating current will contain the requirements for this type including everything required to provide temperature cut off and fire prevention and comply with all countries safety regulations. Likewise hydraulic or pneumatic handles will contain all the required components of these types of tools. The handle may contain the components required for torque sensing and adjusting.

The handle of this tool may be either for manual or powered use.

If manual;

In one embodiment the tool will be comprised of a handle (A) which will strong enough for a person to exert substantial force and not break. This handle will further comprise a pawl (H), a rotation control and a jaw (I) incorporating spring actuated retaining pins or the like (L) and a retaining pin release (J). The Pawl (H) will be placed on the circumference of the jaw (I) to engage the teeth (Q) on the rotating Insert (M). The rotation control will change the rotation of the insert from clockwise to counter-clockwise when actuated by changing the pawl to effect rotation in one direction or the other. To use this tool insert rotating insert (M) into jaw (I) and force it through the retaining pins or other capturing device (L) and use retaining pin release button (J) to increase the opening of the retaining pins (L) if needed. The operator will put the open end of the insert around a fastener and move the handle back and forth. If clockwise rotation is chosen the pawl will engage the insert on the clockwise movement and force the fastener clockwise. On counter clockwise movements the pawl will merely give way and not apply force.

If powered:

The tool in one embodiment will be made and used exactly as the manual tool described above when not engaging the motor.

One embodiment further comprise the handle (A) which will be strong enough to be used manually but will have sufficient volume to contain a motor (D), Battery (B), switch, valve or connection(C), Switch (E), dial (F), mechanism that will turn the insert (G), power cord or hose (Y) and additional circuitry (Z). The motor (D) will be engaged by pressing switch (E) which will complete a circuit or open a valve connecting the motor to an electric current or other method such as air or hydraulic fluid. The motor will operate a mechanism to push the pawl or some other method to rotate the insert. Dial (F) may be used to set the torque of the device. Electronics (Z) may be used to center the insert, provide temperature control or any other needed function. The powered version will be used exactly as the manual version in all other ways except that the motor can be engaged by pressing the switch (E).

The handle will have an open jaw or head set at a good angle to the rest of the handle, 30 degrees or other. The jaw will have a slot for the insert. This jaw will also contain the retaining pins for the rotating insert. The retaining devices may be other than pins such as square or semi-circular configurations that ride in a slot in the insert to retain it while rotating. In a preferred embodiment the pins will sit in holes or wells and be pressed closed with springs.

This handle will be of a hand tool type and strong enough for the purpose and shaped in any way to contain all the needed components and be used by hand. The motor will drive a known system of rotating a component within the head of the handle. This may be by a pushing or pulling a pawl, a worm gear rotating a toothed gear or any other method known in the art. I will call the rotating component the insert.

The handle will contain various controls. One control will be a method of controlling the rotation and index location of the insert. The direction of fastening or loosening can also be reversed by turning the tool over 180 degrees. A powered handle will have a method of increasing or decreasing the speed of rotation of the insert. The powered handle will have a control to increase or decrease the torque applied to the fastener. The handle, powered or manual may have a torque sensor of some type contained within it to allow fasteners to be torqued to accurate specifications.

The tool will have a control to allow inserts to be inserted and removed and yet when attached allow great force to be applied to them without breaking or distorting. This can be accomplished by having a series of pins in the handle that engage a groove in the insert when it is inserted. A control can release or engage these pins onto the insert. These pins may be round with a chamfered tip that will allow the insert to be pressed into the pins with or without depressing a control. The pins will snap into and ride within a square bottomed groove on one or both sides of the insert. These pins will allow the insert that is a circle with part of the circle removed to rotate through 360 degrees without losing its grip on the insert. The method of capturing, holding and turning the insert may be by any method known.

The handle will have a control to activate the insert and rotate it to a neutral position whereby the open part of the insert is in the most advantageous place in relation to the rest of the handle. This neutral finding feature can be accomplished by the insert having a magnet that activates a sensor in the handle to tell the handle it is at the correct angle of rotation or any other type of mechanism. This may consist of a shape like a bump or otherwise on the insert which triggers some type of sensor on the handle. The handle will be constructed in such a way that this sensor and control advance the insert to the right angle of rotation. Any other known system can be used also. The handle may have any other controls known in the art.

In its best mode the insert will consist of a generally round disk with teeth around the outer edge and a groove on one or both sides around the circumference of the disk. The insert will have a slot in it equivalent to the size fastener it will be used to remove or tighten. This slot will continue to the center of the insert so that the fastener when properly seated will be in the exact center of the disk. The center of the disk will increase in thickness to be strong enough to engage and turn a fastener with the required torque. The disk will contain a system for finding its neutral position as mentioned above. Another system or the same system will act on fasteners with a strong magnet to keep the fastener in the center of the rotation of the disk so that the tool can more effectively rotate the insert and the fastener along with it without straying out of the center of the turning insert. This can be accomplished by having a strong magnet inserted in the insert that has one end on the outer edge and its other end on the central part where the fastener will be seated or any other method. Any other method of location can be used including a slight swelling of the slot to create an interference fit for a slight amount of material or perhaps nylon or rubber inserts designed to grip the fastener. The insert will generally be best round but any shape is possible. This round insert comprising any mechanism to remain fixed to the handle while turning and a mechanism allowing them to be rotated with high torque.

Sockets will be created for this system that are a typical socket type on one side but that incorporate the elements of the insert above to engage the handle. Specifically a round insert comprising a mechanism to remain fixed to the handle and a mechanism allowing them to be rotated with high torque.

Extensions, swivels and all other socket set accessories will be created that are of the typical type on one end but that incorporates the elements of the insert above to engage the handle.

Additional accessories such as an insert that is structured as a flare nut wrench will be available as well as any other type of tool that can be adapted to run on this handle with the incorporation of the above features. A flare nut wrench grips a fastener on all six sides and has a slot through which cable, piping or tubing can be passed over or through.

Adapters will be created that incorporates the elements of the insert above to engage the handle but that have a ¼, ⅜. ½ etc. driving element so that the handle can rotate any type of existing socket wrench tool or accessory.

What is claimed is:

1. An apparatus comprising:

d) a "C" shaped housing with a slot toward the open portion of the housing midway between the top and bottom of the housing and wells for spring actuated retaining devices along the interior perimeter of the housing, a series of pins, lands, semicircular shapes or other type of capturing devices that will allow an accessory to be captured and to rotate and allow a firm torque to be applied; and e) an accessory comprising a rotating insert generally circular with a groove which can be placed anywhere on the surface of one or both sides but which will be best placed around the circumference near the edge, this rotating insert is inserted into the housing to use the apparatus;

f) a button or other device on the housing which when activated will relieve tension on springs and cause a locking mechanism of the housing to be unlocked so that the rotating inserts can be inserted or released.

2. An apparatus comprising:

a) a tool comprising a "C" shaped housing with a slot toward the open portion of the housing midway between the top and bottom of the housing and wells for spring actuated retaining devices along the interior perimeter of the housing, a series of pins, lands, semi-circular shapes or other type of capturing devices that will allow an accessory to be captured and to rotate and allow a firm torque to be applied and a pawl or other device in the housing that will engage an accessory and turn it; and b) an accessory comprising a rotating insert generally circular with a groove which can be placed anywhere on the surface of one or both sides but which will be best placed around the circumference near the edge, this rotating insert is inserted into the housing to use the apparatus;

c) a button or other device which when activated will relieve tension on springs and cause a locking mechanism of the housing to be unlocked so that the rotating inserts can be inserted or released;

d) a handle.

3. An open ended wrench for grasping and turning nuts, bolts and fasteners comprising:

a) a tool comprising a "C" shaped housing with a slot toward the open portion of the housing midway between the top and bottom of the housing and wells for spring actuated retaining devices along the interior perimeter of the housing, a series of pins, lands, semi-circular shapes or other type of capturing devices that will allow an accessory to be captured and to rotate and allow a firm torque to be applied and a pawl or other device in the housing that will engage an accessory and turn it; and b) an accessory comprising a rotating insert generally circular with a groove which can be placed anywhere on the surface of one or both sides but which will be best placed around the circumference near the edge, this rotating insert is inserted into the housing to use the apparatus;

c) a button or other device which when activated will relieve tension on springs and cause a locking mechanism of the housing to be unlocked so that the rotating inserts can be inserted or released;

d) a handle.

4. The apparatus of claim 3, further comprising a sensor in the housing that will sense when the rotating insert is rotated to the optimal position.

5. The apparatus of claim 3, further comprising, a rotating insert with teeth around its outer edge which will be used to engage with the operation of the handle these may be of several angles depending on whether operation is by a pawl of some type a worm screw or otherwise.

6. The apparatus of claim 3, further comprising the central area of the rotating insert that will be swelled in thickness providing sufficient strength and control to appropriately capture and turn a fastener whose size this insert is, the center of the insert that will be sized to turn appropriate fasteners.

7. The apparatus of claim 3, further comprising, the slot in the rotating insert may have a slight chamfer where it opens to allow it to more easily slide over a fastener with the same approximate width.

8. The apparatus of claim 3, further comprising, a slot in the rotating insert may have a mechanism by which it will allow a fastener to be more physically captured by the insert, this may consist of a very slight protuberance in the casting to create an interference fit or small nylon or rubber knobs or any other known configuration that will hold thhe fastener in the center.

9. The apparatus of claim 3, further comprising a magnet in the rotating insert that will help to capture fasteners and keep them centered in the middle of the insert while turning.

10. The apparatus of claim 3, further comprising in the insert a magnet or a bump to activate a sensor in the jaw to indicate when the insert is at its optimal open angle.

11. The apparatus of claim 3, further comprising a compartment in the handle that would be used to contain a battery, reservoir or other power source or component for the tool if powered.

12. The apparatus of claim 3, further comprising a switch, valve or control between a power source and another device in the handle.

13. The apparatus of claim 3, further comprising a motor or motivating unit powered by any means such as batteries, alternating current, pneumatics, hydraulics, an engine or any other.

14. The apparatus of claim 3, further comprising a switch whose function will be to rotate the insert to its proper index location, set the tool to forward neutral reverse and variable speed in either direction.

15. The apparatus of claim 3, further comprising a dial or some other control to increase or decrease the torque of the tightening of the device.

16. The apparatus of claim 3, further comprising a mechanism that will actually turn the rotating insert in the housing, a worm and gear device or a pawl that pushes or pulls the rotating insert in the housing.

17. The apparatus of claim 3, further comprising, in the handle any other needed circuitry or controls which may consist of a TCO, or potentiometer for torque sensing or any other needed mechanism.

* * * * *